United States Patent [19]

Koch

[11] 3,999,590

[45] Dec. 28, 1976

[54] CURTAIN FABRIC USED FOR PLEATED CURTAINS

[75] Inventor: Eva Marie Koch, Neviges, Germany

[73] Assignee: Vorwerk & Sohn, Wuppertal-Barmen, Germany

[22] Filed: Apr. 16, 1975

[21] Appl. No.: 568,573

[30] Foreign Application Priority Data

Apr. 19, 1974 Germany ..... 2418884

[52] U.S. Cl. ..... 160/84 R; 160/348

[51] Int. Cl.[2] ..... A47H 13/14

[58] Field of Search ..... 160/348, 344, 345, 346, 160/347, 330, 84 R

[56] References Cited

UNITED STATES PATENTS

| | | | |
|---|---|---|---|
| 3,160,202 | 12/1964 | Rosen | 160/348 X |
| 3,335,762 | 8/1967 | Noyel | 160/348 X |
| 3,439,725 | 4/1969 | Haimovitz et al. | 160/84 R |
| 3,774,666 | 11/1973 | Bunger | 160/348 |
| 3,777,800 | 12/1973 | Susoev | 160/84 R |
| 3,791,436 | 2/1974 | Weckbrodt | 160/348 |
| 3,952,788 | 4/1976 | Scholer | 160/84 R |

*Primary Examiner*—Philip C. Kannan
*Attorney, Agent, or Firm*—Holman & Stern

[57] ABSTRACT

A curtain fabric for pleated curtains is disclosed wherein the cord guiding loops are provided during manufacture. Additionally, various reinforcement patterns, also to be provided during manufacture of the fabric, are disclosed.

5 Claims, 6 Drawing Figures

CURTAIN FABRIC USED FOR PLEATED CURTAINS

BACKGROUND OF THE INVENTION

The present invention concerns a curtain fabric comprising woven or knitted materials to be utilized for pleated curtains, wherein the pleated curtain is provided on its back side with a supporting tape attached at the upper edge of the curtain. Hanger means are fastened to the supporting tape, serving as carrying and cord-guiding elements and are insertable into the prior art curtain rails. Tapes are fastened to the curtain in the longitudinal direction of the curtain. The tapes are arranged spaced-apart and have loops worked thereinto. Pull cords, which are fastened to the bottom edge of the curtain, are guided through the loops in a manner so that the curtain, under simultaneous operation of all pull cords, is evenly pulled upwards and is thereby placed in horizontal pleats which extend across the entire width of the curtain.

Curtain fabrics which are utilized in the described manner for pleated curtains, are disclosed in the prior art by the German Utility Patent No. 7,242,509. In addition to the advantages which are offered by this prior art pleated curtain with regards having the tapes incorporating the loops, as well as the possibility of hanging the same on a prior art curtain rail, the attaching of the loop-tape on the curtain fabric, for example, by means of stitching, requires a great amount of expertise and a substantial amount of time. Additionally, the generally white-colored loop-tapes which are attached to the backside of mostly differently-colored curtains, do not contribute to the color-scheme of a room.

OBJECT AND SUMMARY OF THE INVENTION

It is the object of the present invention to eliminate the cost of manufacturing a separate loop-containing tape and the cost of stitching said tape onto the curtain, while ensuring the functionality of the pleated curtain mechanism and an even pleat-formation. This object and others are attained by providing the curtain fabric, which is to be utilized for pleated curtains, with the loops during the manufacturing process of such fabric, eliminating thereby the need to attach separate loop-tapes to the backside of the fold-up curtain fabric. The loops are arranged in identical positioning as those of the separate loop-tapes. An advantage offered by the curtain fabric so manufactured comprises, in addition of the time and effort and costs saved for the separate loop-tapes and of attaching the same to the curtain, the fact that such a pleated curtain can easily be made by the housewife since all that is left to do to produce the pleated curtain is to attach to the fabric a carrying-tape for hanging the curtain onto the curtain-rail, and to insert the pull-cords.

An even and secure pleat-formation of the curtain, i.e., the desired objective that the curtain fabric place itself during the upwards pulling of the curtain into the same pleat-foldline, is obtained by the present invention by providing the fabric with intermittent reinforcements in vertical and horizontal directions of the fabric. The reinforcements are produced by means of a tighter weaving or knitting of the fabric or by means of a different type of cross-weaving within the respective manufacturing process.

In contrast to the prior art intermittent reinforcements which are provided as a part of the loop-tapes, the reinforcements which are incorporated into the inventive curtain fabric during its manufacture, and are placed in the cross- and/or longitudinal direction of the curtain fabric, produce substantially sharper fold-lines and smoother pleat sections which, when the curtain is pulled up, produce a smooth and precise pleat-pillow.

Depending on the type of fabric, the thickness of the fabric and its density of weaving, and the type of manufacture or type of design of the curtain fabric, the non-reinforced zones can be arranged each in the form of a small strip extending horizontally over the width of the curtain pleat fold-line, or the curtain fabric may have intermittently reinforced and non-reinforced zones extending over the entire fabric width, the height of said zones being limited by the pleat fold-line.

In striped fabrics, especially for reasons of saving on material, the curtain fabric can be provided with reinforced zones which are arranged in strips in the area of the loop in the longitudinal direction of the curtain fabric. These reinforced zones are interrupted at the crease of the fold-line of the pleat. The effect of the reinforcement is not reduced when each second reinforcement is eliminated from this strip-like reinforcement arrangement, so that the curtain fabric has alternating reinforced and non-reinforced zones extending over the longitudinal direction of the curtain fabric. The length of said zones are limited by the fold-lines of the pleats. The reinforced and non-reinforced zones can also be arranged intermittently in the crosswise direction.

BRIEF DESCRIPTION OF THE DRAWINGS

The present invention is shown in greater detail by the embodiments illustrated in the drawings, wherein.

DETAILED DESCRIPTION OF THE PREFERRED EMBODIMENTS

Figure 1:
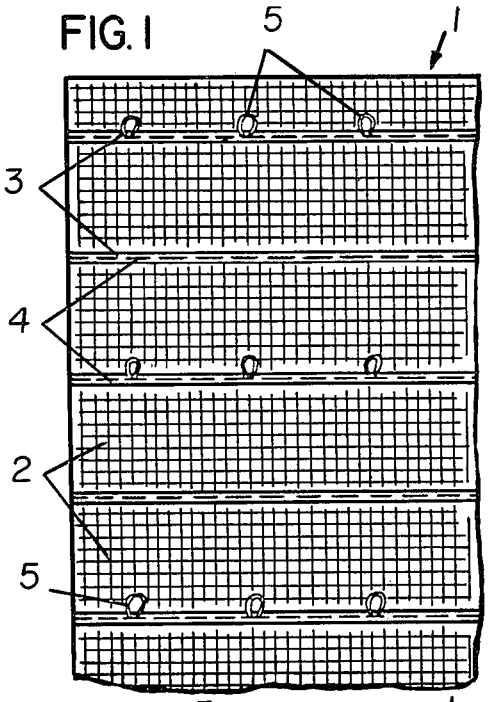
FIGS. 1 to 4 show the backside of the curtain fabric of the instant invention with a multitude of variations of the arrangement of reinforcing zones.
Figure 2:
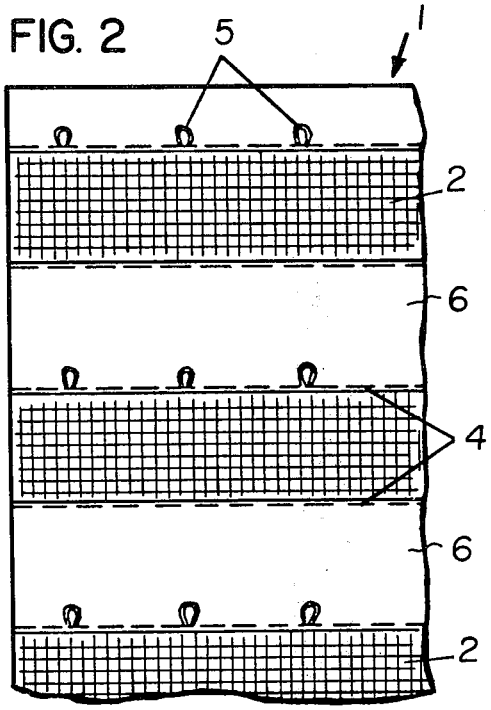

The curtain fabric 1 may be produced from any textile threads by means of weaving or knitting and may be of any design and color variation which is technically producable. The curtain fabric 1 of FIG. 1 is provided with reinforcements 2 which are worked into its entire area and are obtained by means of tighter weaving or tighter knitting, or by means of a different crossweaving during the respective manufacturing process. The reinforcements 2, which are only interrupted by a small non-reinforced strip 3 along the fold-line 4 of the pleat shown by the broken line, are shown clearly in all figures by cross-hatched areas for a distinct differentiation. Along the fold-line 4 of the pleat, there are loops 5 evenly worked into the non-reinforced curtain sections 3, spaced at predetermined distances from each other, during the manufacturing process of the curtain fabric. A variation of this reinforcement arrangement is illustrated in FIG. 2 wherein, in perpendicular series, each second reinforced zone 2 of FIG. 1, which extends across the width of the curtain fabric, has been eliminated so that the reinforced zones 2 and non-reinforced zones 6 extend close to the fold-line 4 of the pleat.

Figure 3:
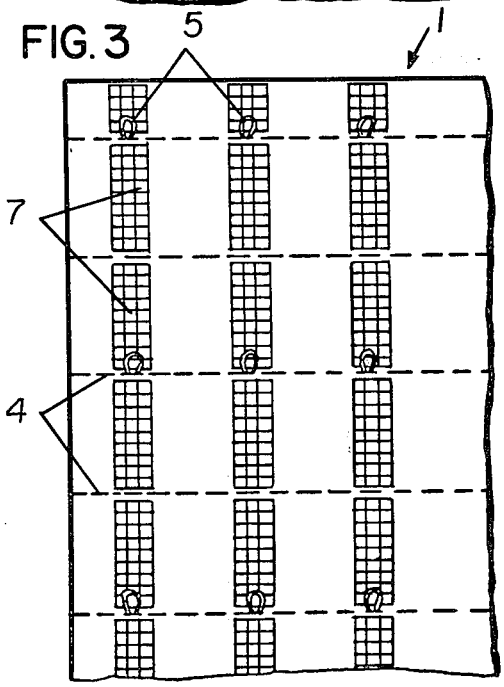

The curtain fabric illustrated in FIG. 3 is provided with a reinforcing zone 7 arranged in strips only in the area of loops 5 and extending in the longitudinal direction of the curtain fabric. The reinforced zones 7 are interrupted at the fold-line 4 of the pleat. According to the arrangement of the reinforced zones in FIG. 3 in the curtain fabric of FIG. 4, each second reinforced zone 7 has been eliminated in the vertical series, so that the reinforced zones 7 alternate with the non-reinforced zones 6.

Figure 4:
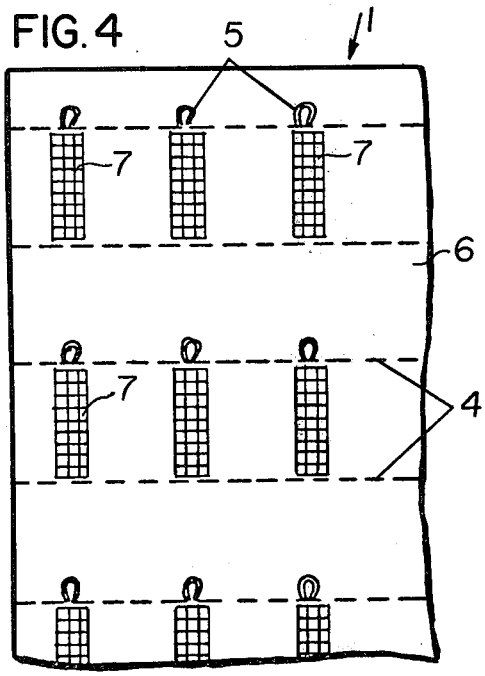
Figure 5:
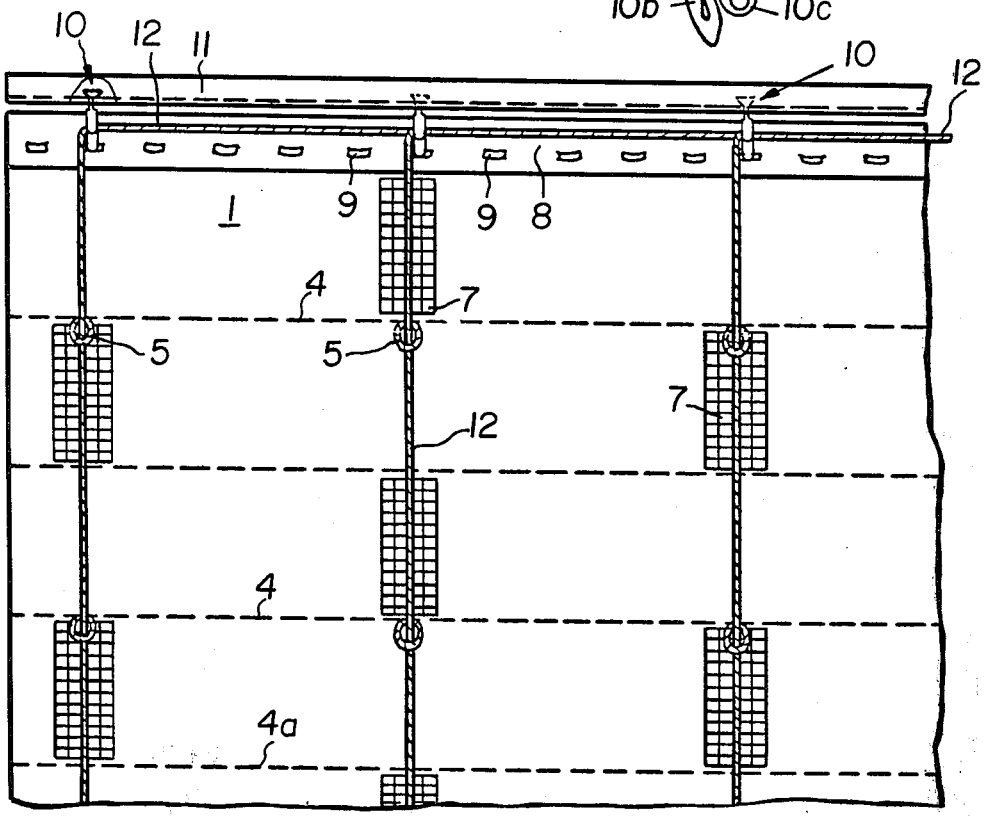
FIG. 5 shows a section of a pleated curtain produced from the curtain fabric of the instant invention.
Figure 6:
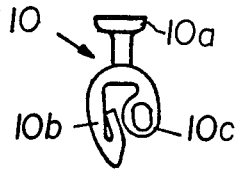
FIG. 6 shows a prior art hanger means which serves as the carrying- and cord-guiding-element.
Figure 6:
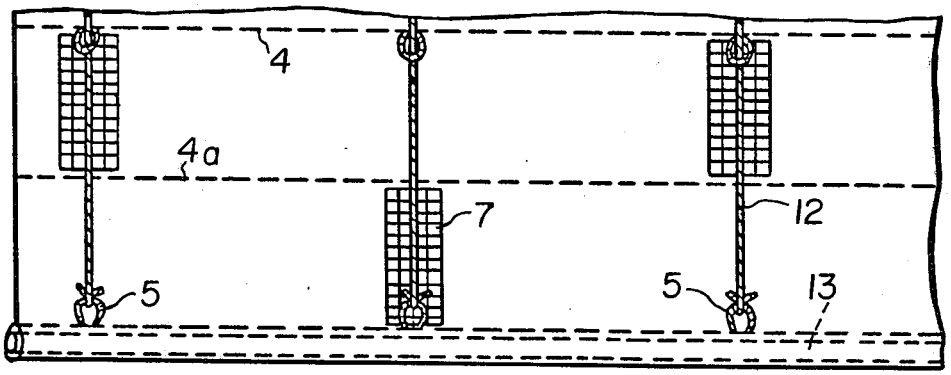

FIG. 5 shows an additional embodiment of the reinforcing arrangement of FIG. 4 in which reinforced zones 7, are worked-in spaced-apart in vertical and horizontal series, i.e., alternately arranged to each other. Further, FIG. 5 illustrates the utilization of this curtain fabric as a pleated curtain. The upper edge of the curtain fabric 1 is provided with a carrier-tape 8, which, in a prior art fashion, is provided with fastening loops 9 for the hangers 10. The hanger 10 comprises, in addition to the prior art glider-means 10*a* (FIG. 6) which is guided in a prior art U-rail 11, a side-portion having a hook 10*b* for hooking into the fastening loops 9 and a further side-portion which is provided with a ring serving to guide the pull cords 12. The pull cords 12 are fastened at the bottom edge of the curtain, into which edge is inserted a weight-rod 13 in a known manner, to a loop 5, for example by tying a knot or securing it by other means, and are pulled vertically upwards to the upper edge of the curtain through the additional loops 5 and through the ring 10*c* of the hanger element 10, the pull cords are guided in horizontal direction through the hanger element 10 which is attached towards the right edge of the curtain. When all of the pull cords 12 are pulled simultaneously, the pleats fold along the fold-lines 4*a* of the pleats in the direction toward the inside of the room (away from the window), whereas they are retained at the fold-lines 4 by means of the loops 5. The alternately arranged reinforcing zones 7 support the pleat-formation and are very effective, functioning as distance-retainers between the fold-lines 4 and 4*a* of the pleats.

What is claimed is:

1. Curtain fabric comprising woven or knitted materials of cross-woven thread-combination, which fabric is to be utilized for pleated curtains, comprising: a carrier-tape fastened to the upper edge at the backside of the curtain fabric; hanger means fastened to said carrier tape serving as support and cord-guiding elements and adapted to be inserted into a curtain rail; loops extending, in a spaced relationship, from said curtain fabric; and pull-cords fastened at the bottom edge of the curtain and guided through said loops in vertical and horizontal pull-direction in such a manner so that the curtain, under simultaneous operation of all pull-cords, is evenly pulled upwards and is thereby placed into pleats which extend horizontally across the entire width of the curtain; the improvement comprising: said loops being integrally attached to said curtain fabric during its manufacture; said curtain fabric being provided with reinforced zones by means of tighter weaving, or knitting, across the width of the curtain fabric; and said reinforced zones of the curtain fabric are interrupted by a narrow non-reinforced strip along a fold-line of the pleats which pleats extend horizontally across the entire width of the curtain.

2. Curtain fabric comprising woven or knitted materials of cross-woven thread-combination, which fabric is to be utilized for pleated curtains, comprising: a carrier-tape fastened to the upper edge at the backside of the curtain fabric; hanger means fastened to said carrier tape serving as support and cord-guiding elements and adapted to be inserted into a curtain rail; loops extending, in a spaced relationship, from said curtain fabric; and pull-cords fastened at the bottom edge of the curtain and guided through said loops in vertical and horizontal pull-direction in such a manner so that the curtain, under simultaneous operation of all pull-cords, is evenly pulled upwards and is thereby placed into pleats which extend horizontally across the entire width of the curtain; the improvement comprising: said loops being integrally attached to said curtain fabric during its manufacture; said fabric being provided with alternately reinforced and non-reinforced zones extending across the width of the fabric, the height of each zone being limited by each fold-line of the pleats, said reinforced zones being provided by means of tighter weaving or knitting.

3. Curtain fabric comprising woven or knitted materials of cross-woven thread-combination, which fabric is to be utilized for pleated curtains, comprising: a carrier-tape fastened to the upper edge at the backside of the curtain fabric; hanger means fastened to said carrier tape serving as support and cord-guiding elements and adapted to be inserted into a curtain rail; loops extending, in a spaced relationship, from said curtain fabric; and pull-cords fastened at the bottom edge of the curtain and guided through said loops in vertical and horizontal pull-direction in such a manner so that the curtain, under simultaneous operation of all pull-cords, is evenly pulled upwards and is thereby placed into pleats which extend horizontally across the entire width of the curtain; the improvement comprising: said loops being integrally attached to said curtain fabric during its manufacture; said fabric being provided with reinforced zones extending in the vertical direction of the fabric, and being arranged in the form of strips in the area of the loops, said reinforced zones being interrupted at each fold-line of the pleats.

4. The curtain fabric according to claim 3, wherein said reinforced zones alternate with said non-reinforced zones in strip-fashion, the length of said zones being limited by the fold-lines of the pleats.

5. The curtain fabric according to claim 4, wherein the reinforced zones are arranged alternately to each other in the horizontal direction.

* * * * *